US006083034A

United States Patent [19]

Kameyama

[11] Patent Number: 6,083,034

[45] Date of Patent: Jul. 4, 2000

[54] CONNECTING STRUCTURE FOR COAXIAL CABLE CONNECTOR AND METHOD FOR CONNECTING THE SAME

[75] Inventor: Isao Kameyama, Shizuoka, Japan

[73] Assignee: Yazaki Corporation, Tokyo, Japan

[21] Appl. No.: 09/184,741

[22] Filed: Nov. 3, 1998

[30] Foreign Application Priority Data

Nov. 7, 1997 [JP] Japan ..... 9-305977

[51] Int. Cl.[7] ..... H01R 4/24; H01R 4/26; H01R 11/20

[52] U.S. Cl. ..... 439/394

[58] Field of Search ..... 439/394, 98, 585

[56] References Cited

U.S. PATENT DOCUMENTS 3,828,298 8/1974 Schumacher ..... 439/394
5,603,636 2/1997 Kanou ..... 439/585

FOREIGN PATENT DOCUMENTS 6-275326 9/1994 Japan ..... H01R 4/18

*Primary Examiner*—Khiem Nguyen
*Assistant Examiner*—Javaid Nasri
*Attorney, Agent, or Firm*—Sughrue, Mion, Zinn, Macpeak & Seas, PLLC

[57] ABSTRACT

A connecting structure of a coaxial cable connector for a coaxial cable one end of which is worked in such a manner that a core wire is exposed by a predetermined length from an insulating inner cover and a braided wire is exposed by a predetermined length from an insulating outer cover, the connecting structure comprises a first contact member for connecting electrically with the core wire, a second contact member for inserting between the insulating inner cover and the braided wire to be electrically connected with the braided wire, a third contact member arranged outside of the second contact member to urge the braided wire against the second contact member, the third contact member being conductive with the second contact member.

6 Claims, 5 Drawing Sheets

CONNECTING STRUCTURE FOR COAXIAL CABLE CONNECTOR AND METHOD FOR CONNECTING THE SAME

BACKGROUND OF THE INVENTION

The present invention relates to a connecting structure for a coaxial cable connector and a method for connecting the same.

Conventionally, for example, to connect and fix a coaxial cable connector such as a jack connector or the like to a coaxial cable for use in an antenna or the like, there is used such a method as shown in FIG. 6. In this conventional method, at first, as shown in FIG. 6, in the end portion of a coaxial cable 1, an insulating inner cover 3 covering a core wire 2 is peeled off to thereby expose the core wire 2 by a predetermined length, an insulating outer cover 5 is peeled off by a predetermined length to thereby expose a braided wire 4 provided on the periphery of the insulating inner cover 3, the thus exposed braided wires 4 are collected together into a bundle, and the thus formed bundle is treated in such a manner that it extends along the outer peripheral face of the insulating outer cover 5.

And, after the core wire 2 is secured and connected to a connecting hole 7 formed in an inner metal contact 6, the inner metal contact 6 and the end portion of the coaxial cable 1 are inserted into a cylindrical-shaped outer metal contact (jack) 8, and they are clamped so that the braided wire 4 can be contacted with the inner face of a contracted portion 8A formed in the base end portion of the outer metal contact 8.

Now, FIG. 7 shows a state in which the contracted portion 8A of the outer metal contact 8 is clamped. Also, FIG. 8 shows a section view taken along the line A—A shown in FIG. 7. As can be seen from FIG. 8, since the contracted portion 8A of the outer metal contact 8 is clamped, the contracted portion 8A and braided wire 4 are electrically connected with each other. By the way, although not shown, the inner and outer metal contacts 6 and 8 are electrically insulated from each other by an insulator.

However, in the above-mentioned conventional coaxial cable connecting structure, because the insulating inner and outer covers 3 and 5 are both made of synthetic resin, they are easily affected by heat, and as the temperature changes, the insulating inner and outer covers 3 and 5 are easy to contract.

If such contraction occurs, then the pressure contact force between the braided wire 4 disposed on the peripheral face of the insulating outer cover 5 and the contracted portion 8A of the outer metal contact 8 is caused to vary; and, if such variations in the pressure contact force occur, then there can be generated a gap between the braided wire 4 and the contracted portion 8A of the outer metal contact 8. Due to generation of such gap, not only there can occur an electric connection failure, but also the braided wire 4 can be easily oxidized, resulting in the unstabilized electrical connection.

Also, since the braided wires 4 are tied up in a single bundle and are thereby collected together at a single local portion of the peripheral face of the insulating outer cover 5, noises can invade from the portions thereof where no braided wire 4 is disposed.

Further, it is difficult to sort out the braided wires 4 from the periphery of the insulating inner cover 3; that is, such sorting operation is poor in efficiency.

SUMMARY OF THE INVENTION

The present invention aims at eliminating the above drawbacks found in the conventional coaxial cable connecting structure and method. Accordingly, it is an object of the invention to provide a connecting structure for a coaxial cable connector and a method for connecting the same, in which, even if the insulating inner and outer covers contract, the electrical connection thereof with the braided wire can be held positively and the invasion of the noises can be restricted.

In order to achieve the above object, there is provided a connecting structure of a coaxial cable connector for a coaxial cable one end of which is worked in such a manner that a core wire is exposed by a predetermined length from an insulating inner cover and a braided wire is exposed by a predetermined length from an insulating outer cover, the connecting structure comprising: a first contact member for connecting electrically with the core wire; a second contact member for inserting between the insulating inner cover and the braided wire to be electrically connected with the braided wire; a third contact member arranged outside of the second contact member to urge the braided wire against the second contact member, the third contact member being conductive with the second contact member.

Since not only the second contact member is inserted between the insulating inner cover and braided wire but also the third contact member presses the braided wire against the second contact member, both contact members can be positively connected to the braided wire electrically.

The connecting structure may further comprise a clamping member for clamping the insulating outer cover, the clamping member may be formed integrally with the third conductive member.

Since the clamping member is clamped and fixed to the peripheral face of the insulating outer cover, the coaxial cable can be fixed to the connector for a coaxial cable strongly.

In the connecting structure, the second contact member may include a pair of contact pieces, and leading end portions thereof may be so inclined inwardly as to be along the outer peripheral face of the insulating inner cover.

Accordingly, even if the insulating inner cover contracts when heat is applied thereto, the contact pieces can be prevented from moving inwardly together with the contraction of the insulating inner cover. This eliminates the possibility of reducing a contracting force between the contact pieces and the third contact member, thereby being able to secure their contact with the braided wire positively.

In the connecting structure, each of the leading end portions of the second contact member may be formed thinner than any other portion thereof.

Accordingly, the respective leading end portions of the contact pieces can be easily inserted between the insulating inner cover and braided wire.

In the connecting structure, a distance between the leading end portions of the contact pieces may be set shorter than a diameter of the insulating inner cover.

Accordingly, it is possible not only to separate the braided wire from the insulating inner cover easily, but also to increase a contact area of the second contact member and the separated braided wire.

In the present invention, a method for connecting the above connecting structure is also adopted. The method comprises the steps of: connecting the core wire with the first contact member electrically; inserting the second contact member between the insulating inner cover and the braided wire of the coaxial cable to separate one portion of the braided wire from the insulating inner cover and to connect the braided wire with the second contact member electrically; and clamping the third contact member toward the braided wire to connect therewith and to urge the separated portion of the braided wire against the second contact member.

DETAILED DESCRIPTION OF THE PREFERRED EMBODIMENT

Now, description will be given below in detail of an embodiment of a connecting structure for a coaxial cable connector and a method for connecting the same according to the invention with reference to FIGS. 1 to 4.

Figure 1:
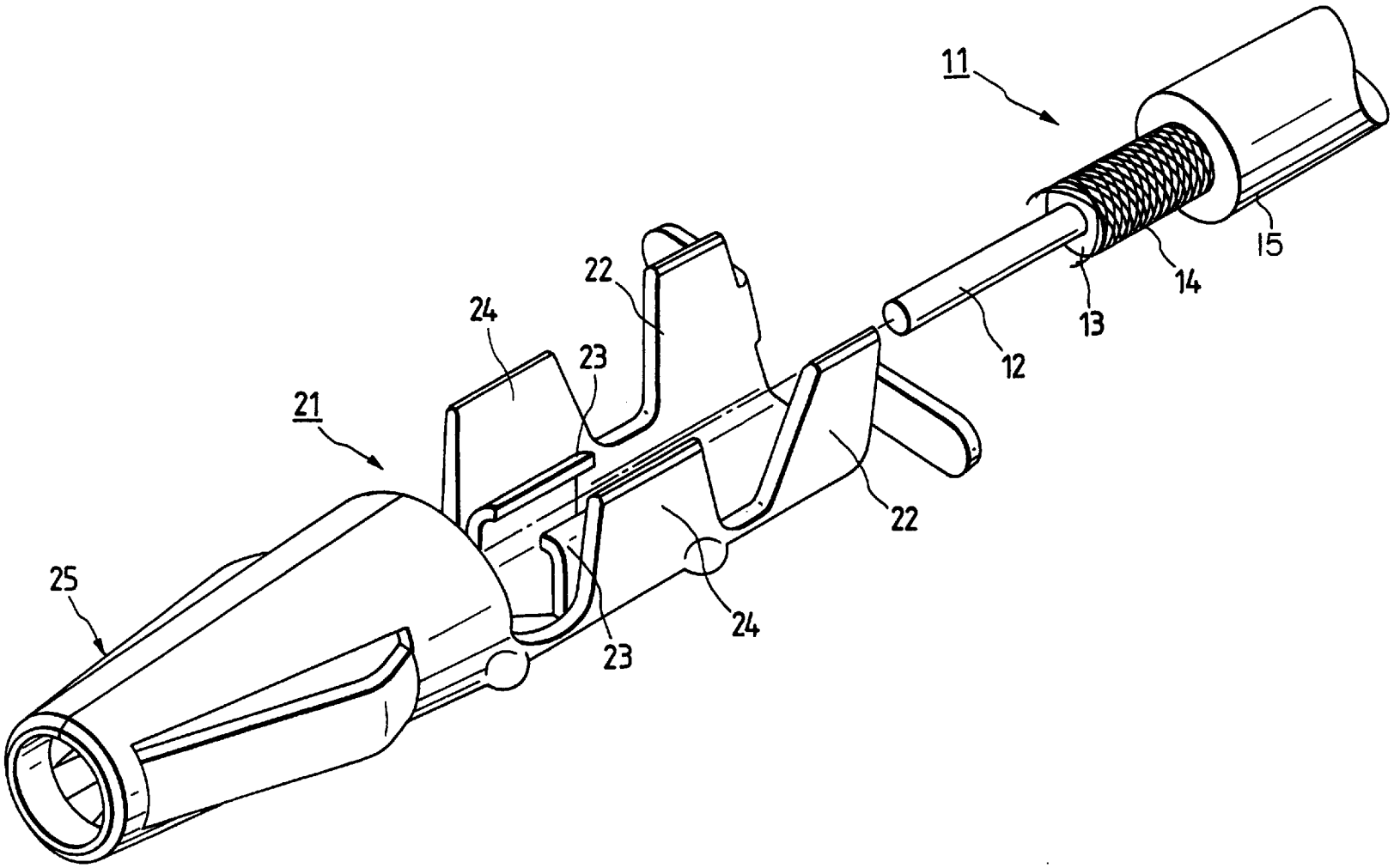
FIG. 1 is an exploded perspective view showing one embodiment of a structure employed in a method for connecting a coaxial cable connector according to the present invention.

At first, description will be given below of the structures of a coaxial cable and a coaxial cable connector with reference to FIG. 1. In FIG. 1, reference character 11 designates a coaxial cable and 21 stands for a coaxial cable connector. To connect and fix the coaxial cable 11 and the connector 21 for a coaxial cable to each other, the connecting end portion of the coaxial cable 11 is firstly worked in such a manner as shown in FIG. 1. That is, the end portion of the coaxial cable 11 is worked in the following manner: at first, in order that a core wire 12 consisting of a single conductor can be exposed by a predetermined length, an insulating outer cover 15 formed of synthetic resin, a braided wire 14 braided over the conductor in a net, and an insulating inner cover 13 formed of synthetic resin are respectively peeled off, and, next, in order to be able to expose the braided wire 14 by a predetermined length, the insulating outer cover 15 is peeled off in such a manner that the core wire 12 and braided wire 14 are exposed through the insulating inner cover 13 in a stepped manner. In this state, the braided wire 14 is covering the whole of the peripheral face of the insulating inner cover 13.

Next, description will be given below of the structure of the connector 21 for a coaxial cable. The connector 21 for a coaxial cable is composed of the following components which are formed integrally with each other: in particular, two fixed pieces 22 which are respectively disposed in the base end portion of the connector 21 on the side thereof to be connected to the coaxial cable 11 and can be clamped to the periphery of the insulating outer cover 15 of the coaxial cable 11 with the end portion thereof worked in the above-mentioned manner; two connecting pieces 23 which are respectively so formed as to correspond to the exposed, braided wire 14 of the coaxial cable 11 with the end portion thereof worked in the above-mentioned manner; and, two connecting and clamping pieces 24 which are respectively so formed as to enclose the outsides of the above connecting pieces 23.

Also, on the free end side of the two connecting and clamping pieces 24, a substantially cylindrical-shaped jack portion 25, which can be fitted with a plug (not shown) that is a partner of the connector 21 for a coaxial cable, is formed integrally with the two connecting and clamping pieces 24. By the way, although not shown, in the inner deep portion of the jack portion 25, there is provided a core wire connecting portion which is electrically insulated from the jack portion 25.

Figure 2:
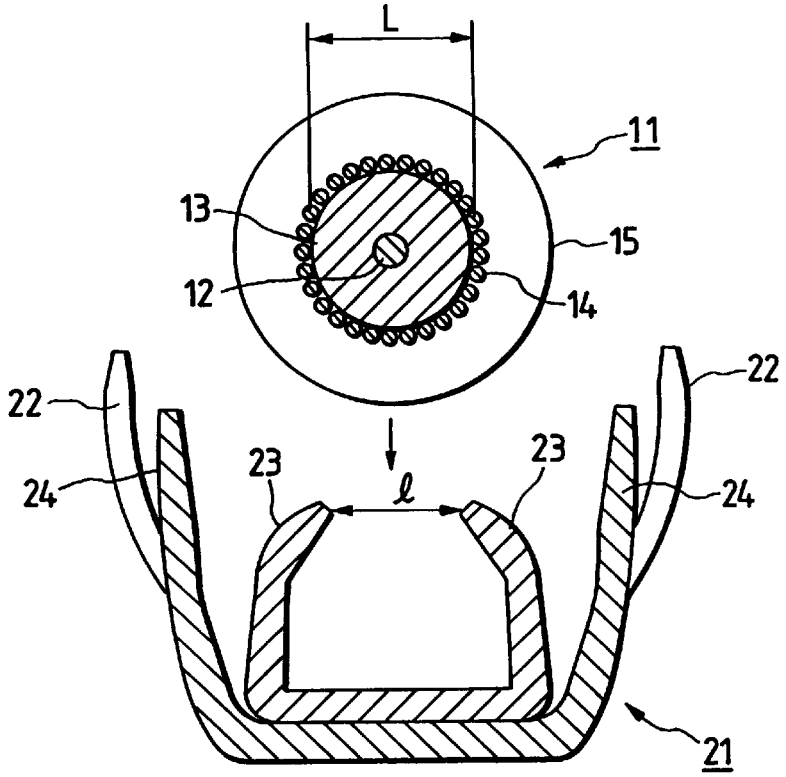
FIG. 2 is a section view showing the connecting structure of the embodiment.

In the present embodiment, the connecting pieces 23 are structured such that, as shown by a section view of the connector 21 for a coaxial cable in FIG. 2, namely, the respective leading end portions of the connecting pieces 23 are inclined inwardly, and a distance l between the leading end portions is set shorter than the diameter L of the insulating inner cover 13. Also, for easy insertion under the braided wire 14, the leading end portions of the connecting pieces 23 are respectively formed thin.

Next, description will be given below of a method for connecting and fixing the connector 21 for a coaxial cable to the end portion of the coaxial cable 11 with reference to FIGS. 1 to 4.

At first, the connecting end portion of the coaxial cable is worked in such a manner as shown FIG. 1. That is, in order that the core wire 12 can be exposed by a predetermined length, the insulating outer cover 15, braided wire 14, and insulating inner cover 13 are respectively peeled off; and, at the same time, in order to be able to expose the braided wire 14 by a predetermined length, the insulating outer cover 15 is peeled off in such a manner that the core wire 12 and braided wire 14 are exposed through the insulating inner cover 13 in a stepped manner.

Figure 3:
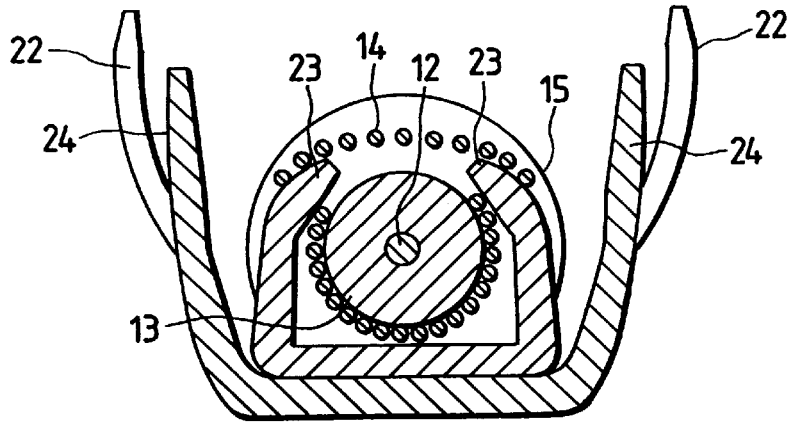
FIG. 3 is a section view showing the connecting structure of the embodiment.

Next, the core wire 12 is engaged and connected with the core wire connecting portion of the jack portion 25 of the connector 21 for a coaxial cable and the exposed braided wire 14 is situated above the connecting pieces 23. And, the connector 21 for a coaxial cable is moved in a direction shown by an arrow in FIG. 2 to thereby push the insulating inner cover 13 enclosed by the braided wire 14 in between the respective leading end portions of the two connecting pieces 23. With such push-in operation, the leading end portions of the two connecting pieces 23, as shown in FIG. 3, separate the contacted portion of the braided wire 14 from the insulating inner cover 13 and enter between the braided wire 14 and the peripheral face of the insulating inner cover 13. In this operation, since the distance l between the respective leading end portions of the two connecting pieces 23 is set shorter than the diameter L of the insulating inner cover 13, with the push-in operation, the two connecting pieces 23 are respectively flexed outwardly and, after then, with the insulating inner cover 13 remaining inserted between the two connecting pieces 23, the two connecting pieces 23 are respectively returned to their respective original positions (FIG. 3). Further, since the upper portions of the two connecting pieces 23 are inclined inwardly, they are allowed to extend over the periphery of the insulating inner cover 13 due to the above return operation.

Figure 4:
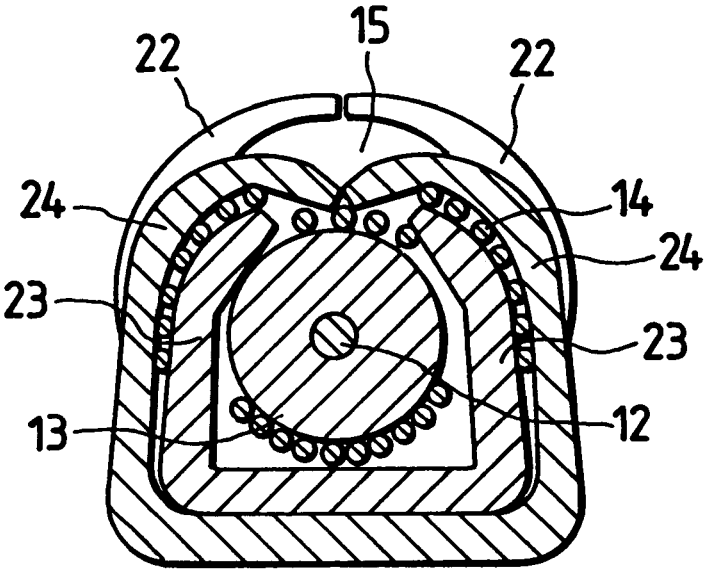
FIG. 4 is a section view showing the connecting structure of the embodiment.

As, as shown in FIG. 4, not only are the connecting and clamping pieces 24 clamped and pressed in such a manner that they cover the braided wire 14, but also the fixing pieces 22 are clamped and pressed in such a manner that they cover the insulating outer cover 15, thereby completing the connecting and fixing operation of the coaxial cable 11 and the connector 21 for a coaxial cable.

When the coaxial cable 11 and the connector 21 for a coaxial cable are connected and fixed to each other in this manner, the connecting and clamping pieces 24 press the braided wire 14 against the connecting pieces 23, there by securing the electrical connection of both of the connecting pieces 23 and the connecting and clamping pieces 24 with respect to the braided wire 14.

Especially, in the present embodiment, since the connecting pieces 23 are strained inwardly due to the press work, connecting and clamping pieces 24, when heat is applied thereto, are going to return to their original positions. That is, when heat is applied thereto, then the connecting pieces 23 are spread outwardly, thereby increasing their contracting forces to be applied onto the connecting and clamping pieces 24. Therefore, even if the insulating inner cover 13 contracts due to the heat, the connection between the coaxial cable 11 and the connector 21 for a coaxial cable can be held positively for the above mentioned reason.

Figure 5:
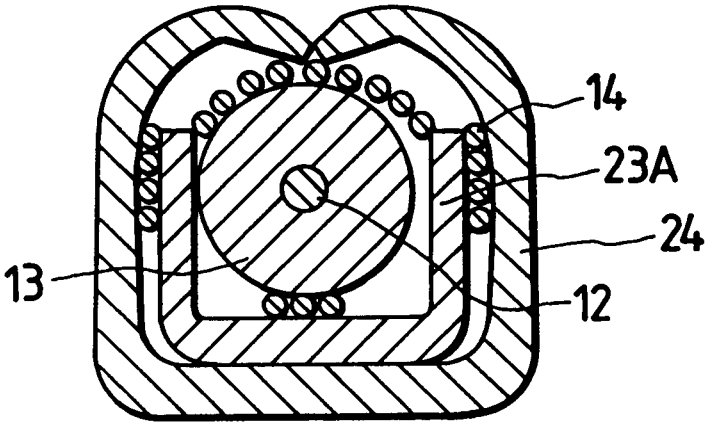
FIG. 5 is a section view showing one example for comparison with the embodiment of the invention shown in FIG. 4.
Figure 6:
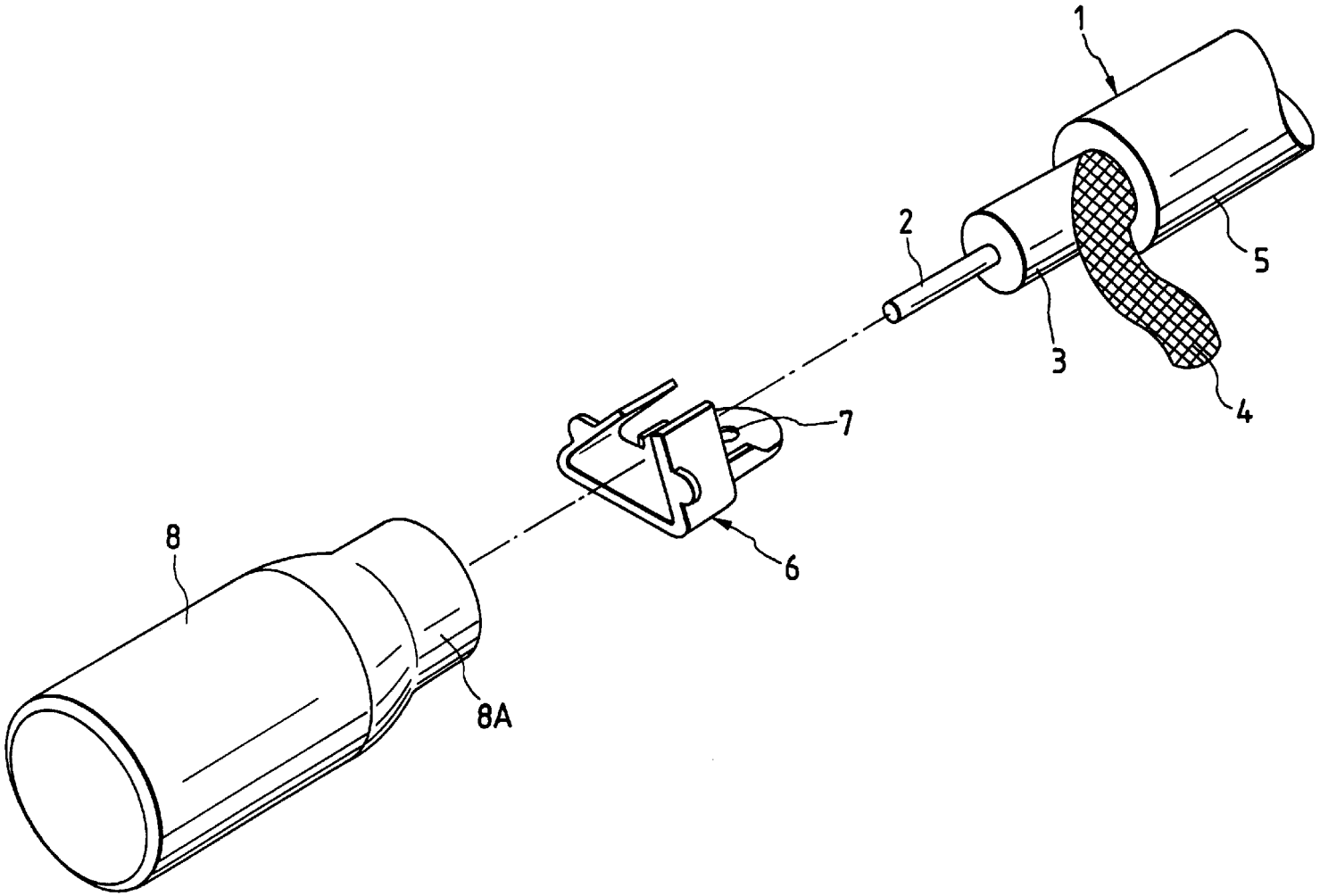
FIG. 6 (PRIOR ART)
FIG. 6 is an exploded perspective view of a structure employed in a conventional connecting method.
Figure 7:
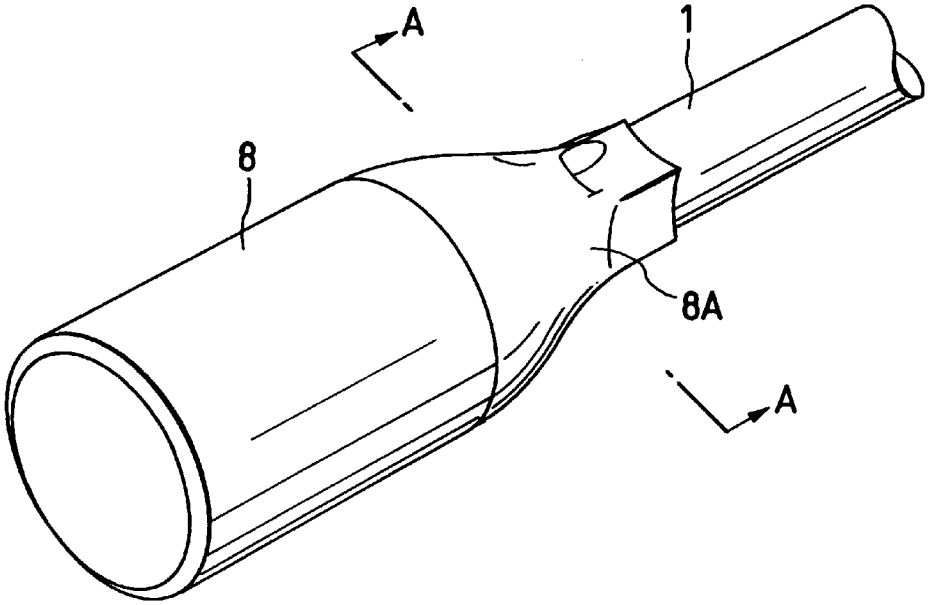
FIG. 7 (PRIOR ART)
FIG. 7 is a perspective view showing the conventional connecting structure; and, FIG. 8 is a section view taken along the line A—A shown in FIG. 7.
Figure 8:
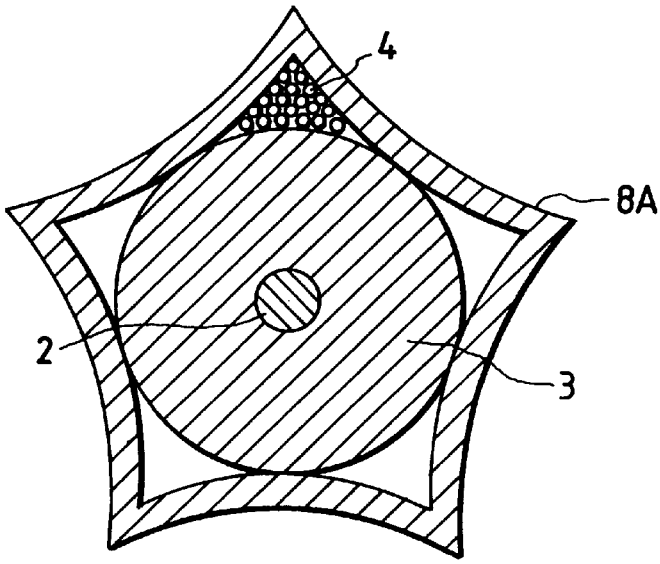
FIG. 8 (PRIOR ART)

By the way, FIG. 5 shows one example for comparison with the connecting structure according to the present embodiment; and, in FIG. 5, there is shown a structure in which two connecting pieces 23A are formed such that they extend substantially in parallel to each other. In the comparison example, since the leading end portions of the two connecting pieces 23A are not inclined inwardly, the contact area of the connecting pieces 23A, which are inserted along the periphery of the insulating inner cover 13, with the braided wire 14 is slightly smaller than the contact area obtained in the connecting structure according to the present embodiment. Also, in the comparison example, because a distance between the respective leading end portions of the connecting pieces 23A are substantially equal to the diameter of the insulating inner cover 13, the function to separate the braided wire 14 and insulating inner cover 13 from each other is lowered when compared the present connecting structure.

Although description has been given heretofore of the connecting structure for the coaxial cable connector and the method for connecting the same according to the invention, the present invention is not limited to the above embodiment but various changes and modifications are possible without departing from the subject matter of the scope of the invention. For example, in the above-mentioned embodiment, the connector 21 for a coaxial cable includes the cylindrical-shaped jack portion 25. However, according to the invention, the jack portion is not limited to this shape.

As can be seen clearly from the foregoing description, according to the present invention, the connecting pieces as well as the connecting and clamping pieces can be positively connected to the braided wire (electrically). Also, since the connecting pieces are inserted between the insulating inner cover and braided wire, the need to tie the up braided wires into a bundle is eliminated and the invasion of noise is restricted.

According to the present invention, by clamping and fixing the fixing piece to the peripheral face of the insulating inner cover, the coaxial cable can be strongly fixed to the present connector for a coaxial cable.

According to the present invention, a contracting force between the connecting pieces and connecting and clamping pieces maintains the electrical contact with the braided wire.

According to the present invention, since the respective leading end portions of the connecting pieces can be easily inserted between the insulating inner cover and braided wire, a connecting operation can be facilitated.

According to the present invention, since a distance between the leading end portions of the contact pieces may be set shorter than a diameter of the insulating inner cover, it is possible not only to separate the braided wire from the insulating inner cover easily, but also to increase a contact area of the second contact member and the separated braided wire.

What is claimed is:

1. A connecting structure for a coaxial cable which receives an end of the coaxial cable, said end having a core wire exposed by a predetermined length from an insulating inner cover and a braided wire exposed by a predetermined length from an insulating outer cover, wherein the connecting structure comprises:

a first contact member inserted between said insulating inner cover and said braided wire, and electrically connected to said braided wire; and a second contact member arranged outside of, and covering, said first contact member to clamp said braided wire against said first contact member, said second contact member being conductive with said first contact member.

2. The connecting structure as set forth in claim 1, further comprising:

a clamping member formed integrally with said second contact member for clamping said insulating outer cover.

3. The connecting structure as set forth in claim 1, wherein said first contact member includes a pair of contact pieces having leading end portions thereof inclined inwardly along an outer peripheral face of the insulating inner cover.

4. The connecting structure as set forth in claim 3, wherein each of said leading end portions of said first contact member is formed thinner than any other portion thereof.

5. The connecting structure as set forth in claim 1, wherein said first contact member includes a pair of contact pieces having leading end portions separated by a distance less than a diameter of said insulating inner cover.

6. A method for connecting a connecting structure of a coaxial cable to an end of a coaxial cable, said end having a core wire exposed by a predetermined length from an insulating inner cover and a braided wire exposed by a predetermined length from an insulating outer cover, and the connecting structure including:

a first contact member inserted between said insulating inner cover and said braided wire, and electrically connected to said braided wire; and a second contact member arranged outside of, and covering, said first contact member and being conductive with said first contact member;

wherein the method comprises the steps of:

(a) inserting said first contact member between said insulating inner cover and said braided wire of said coaxial cable thereby separating one portion of said braided wire from said insulating inner cover and electrically connecting said braided wire with said first contact member; and (b) clamping said second contact member toward said braided wire thereby covering said first contact member and pressing said separated portion of said braided wire against said first contact member to electrically connect therewith.

* * * * *